US012660966B2

(12) United States Patent
Showunmi

(10) Patent No.: US 12,660,966 B2
(45) Date of Patent: Jun. 23, 2026

(54) MOISTENED WIPES DISPENSING DEVICE

(71) Applicant: Kimberly Showunmi, Columbia, SC (US)

(72) Inventor: Kimberly Showunmi, Columbia, SC (US)

( * ) Notice: Subject to any disclaimer, the term of this patent is extended or adjusted under 35 U.S.C. 154(b) by 234 days.

(21) Appl. No.: 18/658,315

(22) Filed: May 8, 2024

(65) Prior Publication Data

US 2025/0344913 A1 Nov. 13, 2025

(51) Int. Cl.
*A47K 10/38* (2006.01)
*A47K 10/32* (2006.01)

(52) U.S. Cl.
CPC ..... *A47K 10/38* (2013.01); *A47K 2010/3266* (2013.01)

(58) Field of Classification Search
CPC .... A47K 10/38; A47K 10/3266; A47K 10/36; A47K 2010/3293; A47K 2010/3668; A47K 10/3612
See application file for complete search history.

(56) References Cited

U.S. PATENT DOCUMENTS 4,721,265 A 1/1988 Hawkins
4,788,909 A * 12/1988 Stewart ..... A47K 10/3818 100/295
7,527,215 B1 * 5/2009 Siddiqui ..... A47K 10/36 242/598.5
8,763,948 B1 7/2014 Holowaty
10,292,544 B1 5/2019 Bonner
11,230,452 B1 1/2022 Razai
11,812,897 B1 * 11/2023 Danis ..... A47K 10/38
2008/0245922 A1 10/2008 Fellhoelter
2015/0297043 A1 * 10/2015 Osborne, Jr. ..... A47K 10/38 242/563.2
2016/0095478 A1 * 4/2016 Toma ..... A47K 10/38 242/594
2022/0361722 A1 11/2022 Soltau

FOREIGN PATENT DOCUMENTS

CA 2985358 11/2016

* cited by examiner

*Primary Examiner* — Timothy R Waggoner

(57) ABSTRACT

A moistened wipes dispensing device includes a stand which includes a base and a stanchion. A dispensing unit is attached to the stanchion such that the dispensing unit is elevated above a support surface to be accessible to a user. The dispensing unit contains a roll of moistened wipes and the dispensing unit has a motion sensing element which actuates the dispensing unit to dispense one of the moistened wipes when the motion sensing element senses motion. Thus, the dispensing unit dispenses one of the moistened wipes when the user approaches the dispensing unit. A dispensing mechanism is movably integrated into the stand which can be manipulated by the user to dispense one of the roll of moistened wipes in the event that the dispensing unit is not operational and will not dispense one of the roll of moistened wipes.

13 Claims, 11 Drawing Sheets

MOISTENED WIPES DISPENSING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to moistened wipes devices and more particularly pertains to a new moistened wipes device for automatically dispensing a moistened wipe. The device includes a stand upon which a dispensing unit is mounted such that the dispensing unit is elevated to be accessible to a user. The device includes a roll of moistened wipes that are positioned in the dispensing unit and a motion sensor that actuates the dispensing unit to dispense a moistened wipe when the motion sensor senses the user has approached the dispensing unit. The device includes a heating element that is actuated when the dispensing unit dispenses a moistened wipe to warm the moistened wipe.

(2) Description of Related Art Including Information Disclosed Under 37 CFR 1.97 and 1.98

The prior art relates to moistened wipes devices including a variety of automated toilet paper dispenser devices that each at least includes a motion sensor and a dispensing unit that is actuated to dispense toilet paper when the motion sensor senses motion and an automated toilet paper dispenser device that includes a heating element and a germicidal light emitter for warming toilet paper and sterilizing toilet paper that is dispensed. In no instance does the prior art disclose an automated moistened wipe dispenser that includes a motion sensor and a dispensing unit for dispensing a moistened wipe when the motion sensor senses motion and a heating element for warming the moistened wipe that is dispensed.

BRIEF SUMMARY OF THE INVENTION

An embodiment of the disclosure meets the needs presented above by generally comprising a stand which includes a base and a stanchion. A dispensing unit is attached to the stanchion such that the dispensing unit is elevated above a support surface to be accessible to a user. The dispensing unit contains a roll of moistened wipes and the dispensing unit has a motion sensing element which actuates the dispensing unit to dispense one of the moistened wipes when the motion sensing element senses motion. Thus, the dispensing unit dispenses one of the moistened wipes when the user approaches the dispensing unit. A dispensing mechanism is movably integrated into the stand which can be manipulated by the user to dispense one of the roll of moistened wipes in the event that the dispensing unit is not operational and will not dispense one of the roll of moistened wipes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
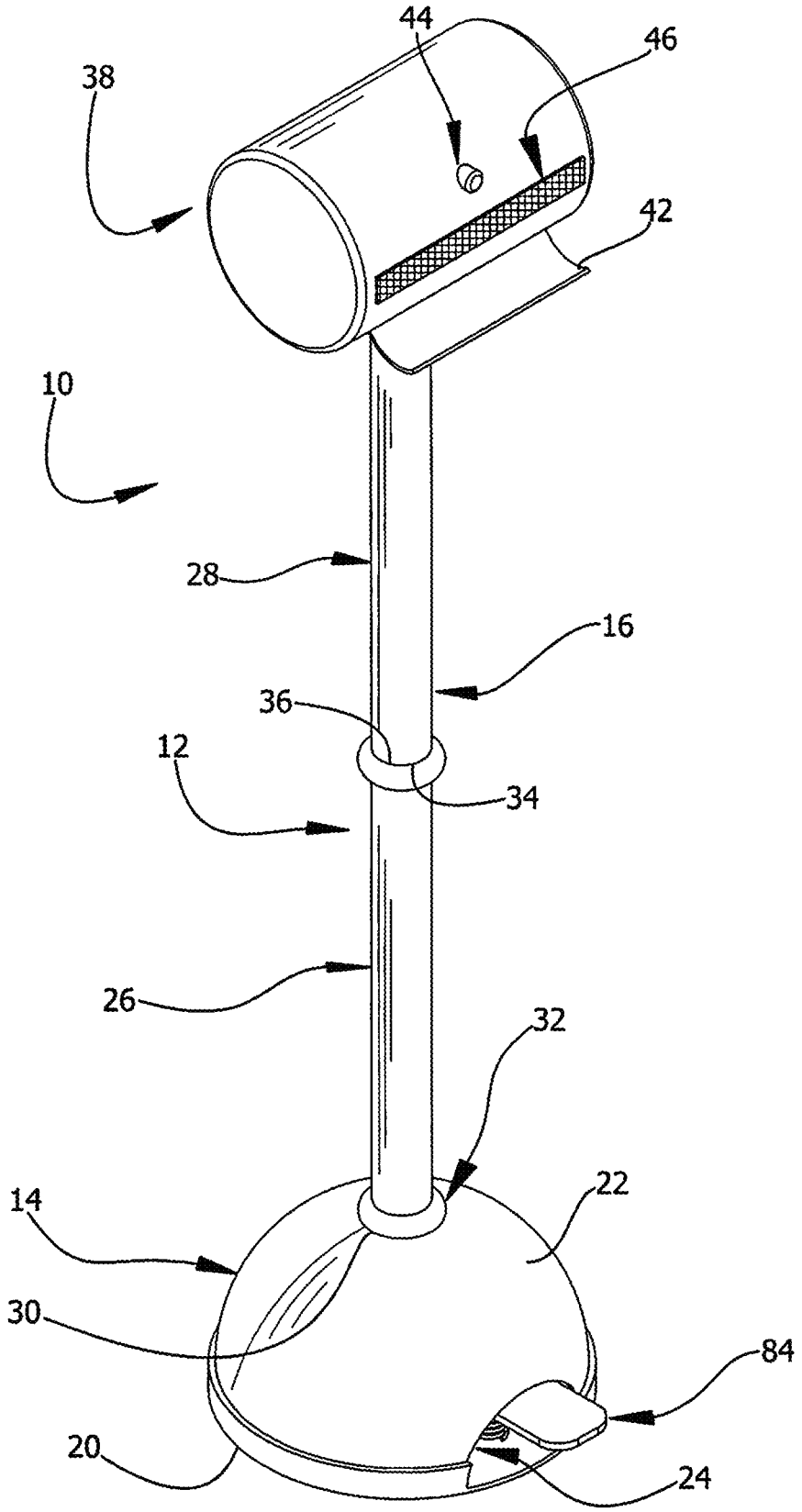
FIG. 1 is a perspective view of a moistened wipes dispensing device according to an embodiment of the disclosure.
Figure 2:
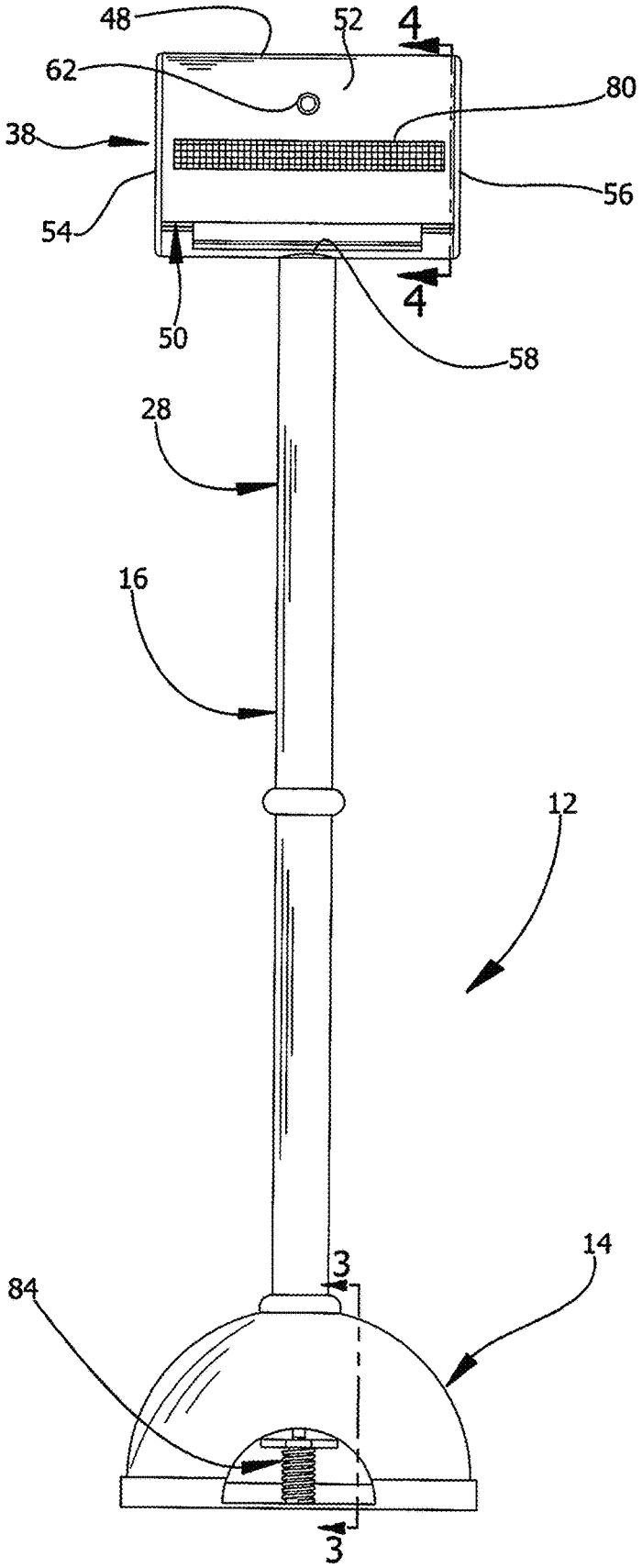
FIG. 2 is a front view of an embodiment of the disclosure.
Figure 3:
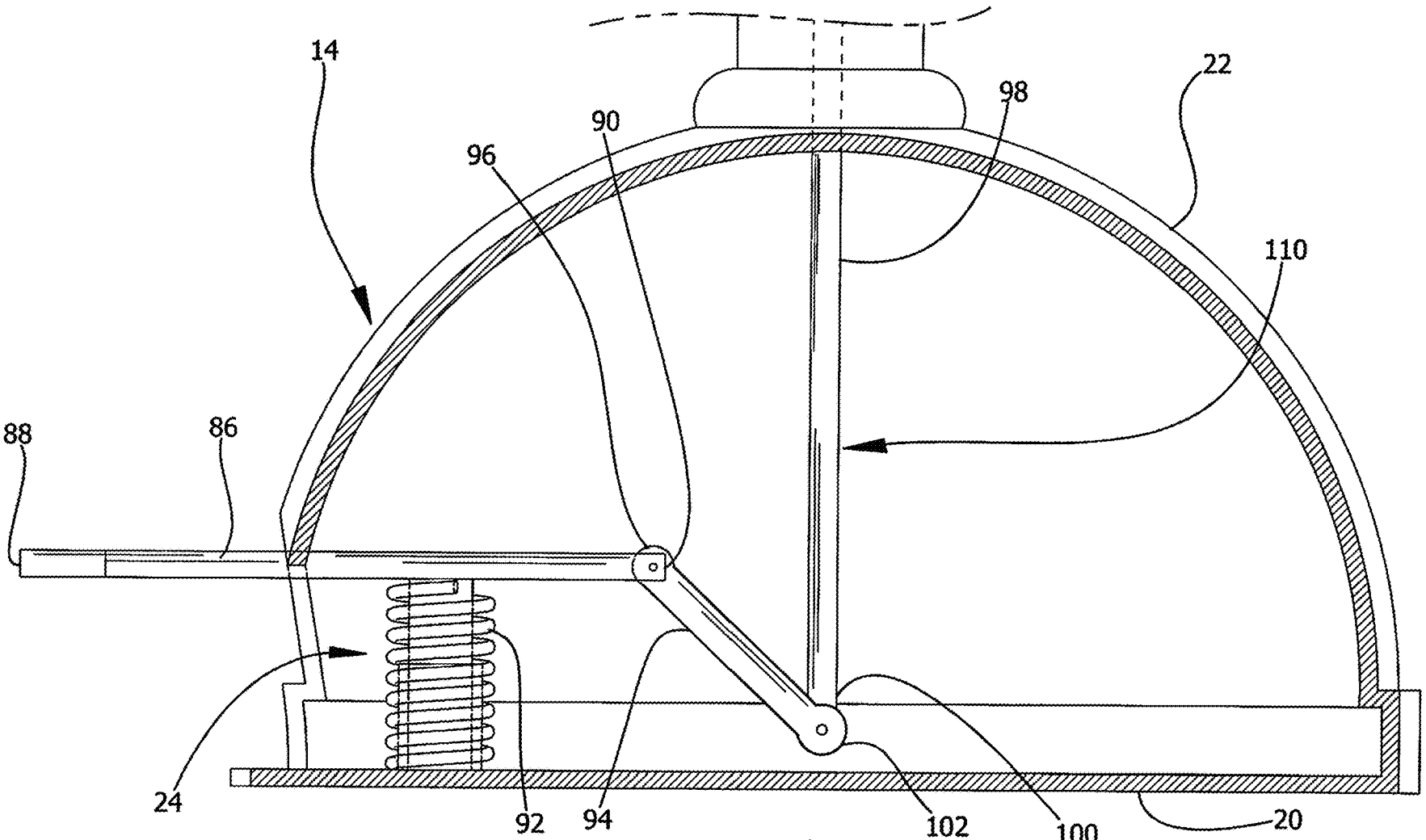
FIG. 3 is a cross sectional view taken along line 3-3 of FIG. 2 of an embodiment of the disclosure.
Figure 4:
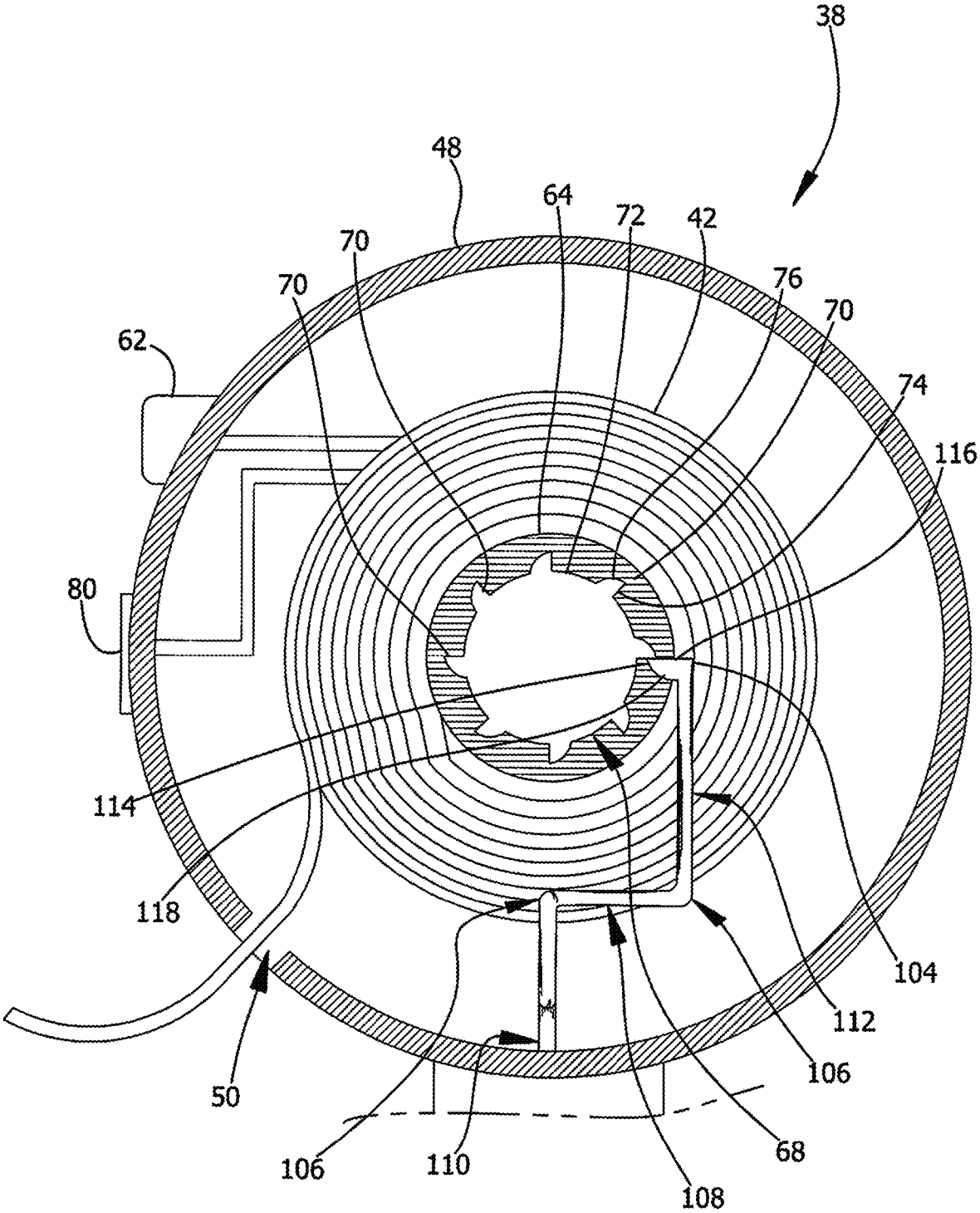
FIG. 4 is a cross sectional view taken along line 4-4 of FIG. 2 of an embodiment of the disclosure.
Figure 5:
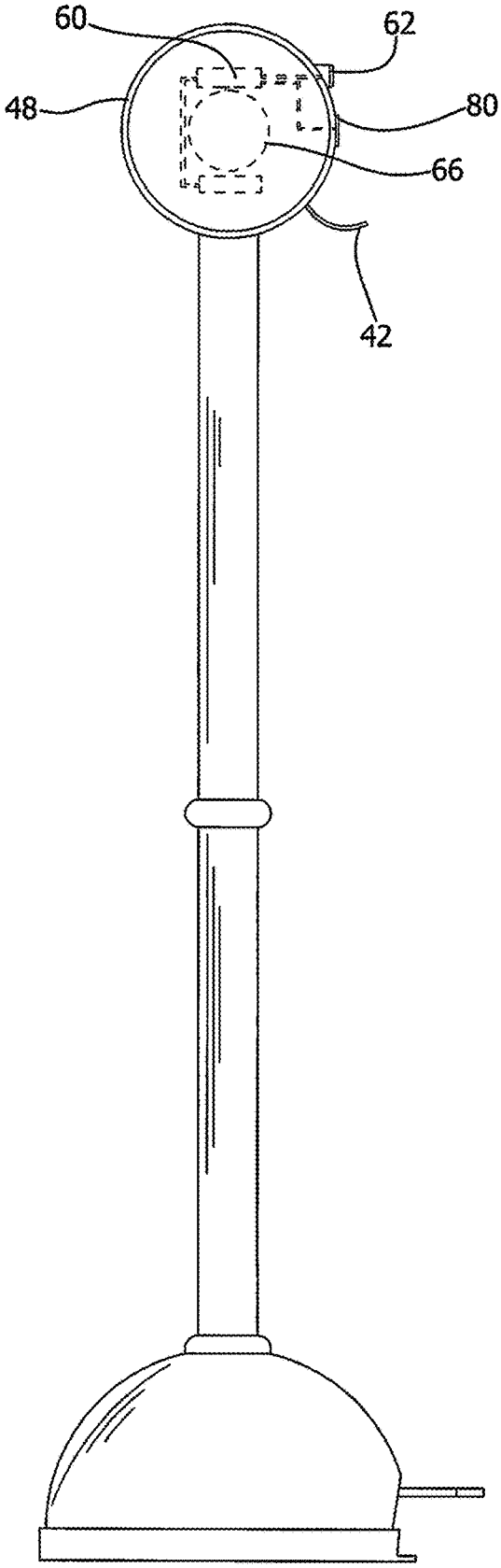
FIG. 5 is a right side phantom view of an embodiment of the disclosure.
Figure 6:
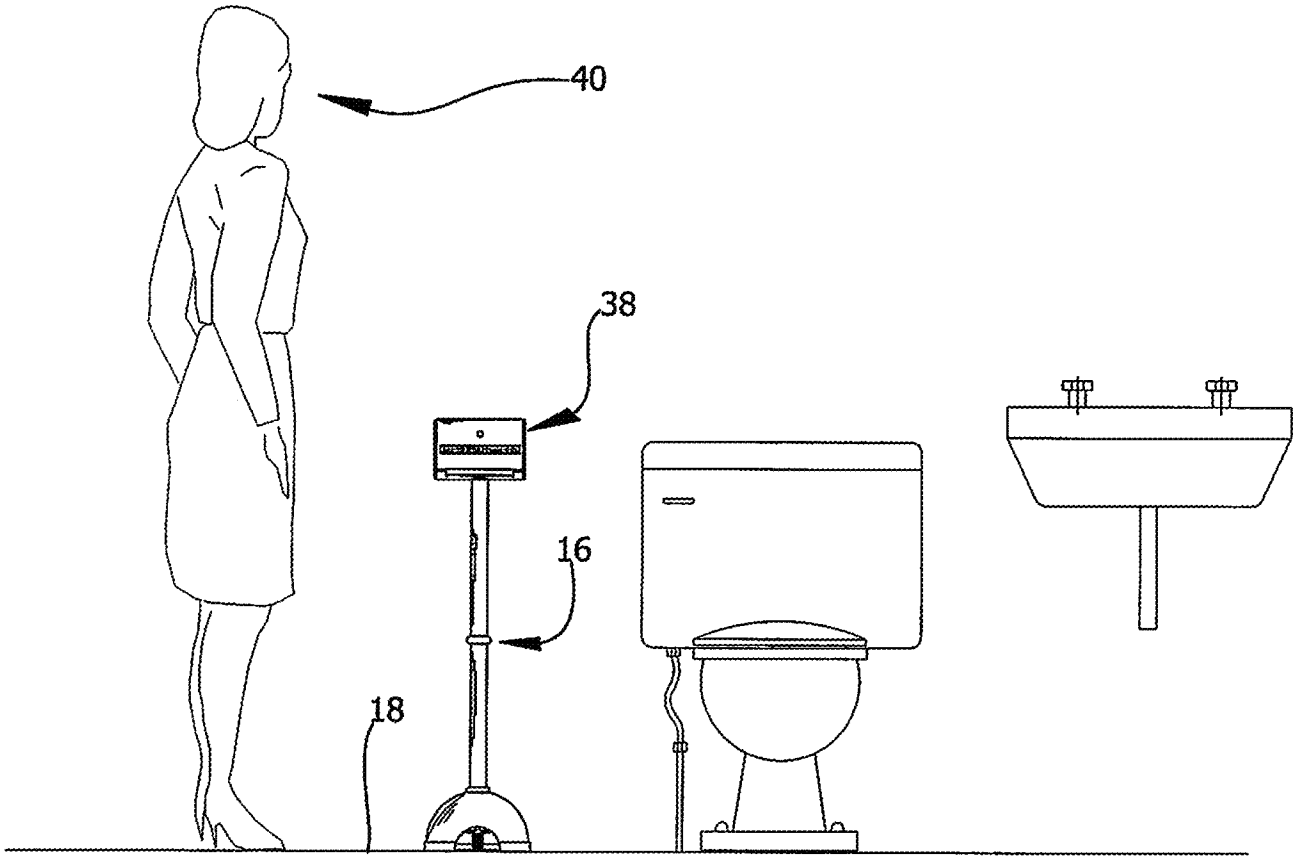
FIG. 6 is a perspective in-use view of an embodiment of the disclosure.
Figure 7:
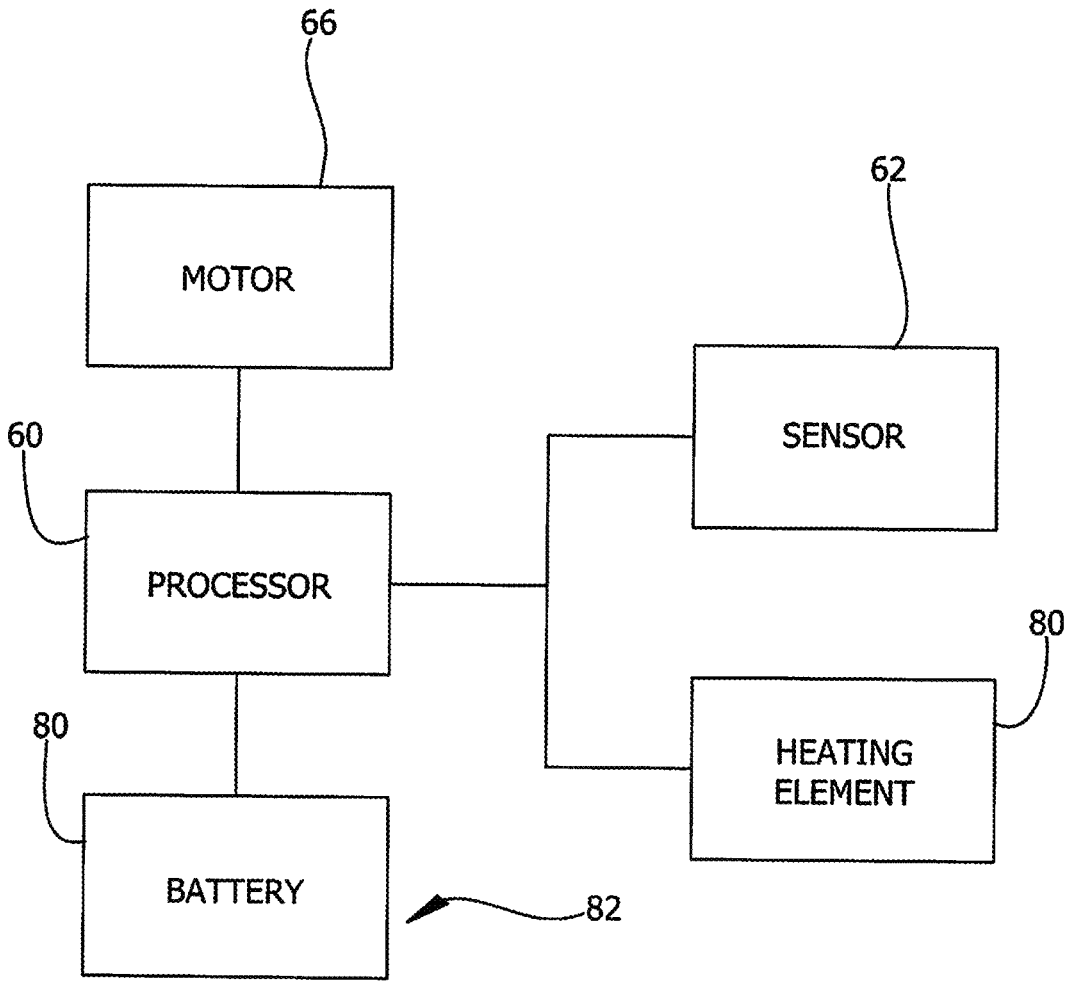
FIG. 7 is a schematic view of an embodiment of the disclosure.
Figure 8:
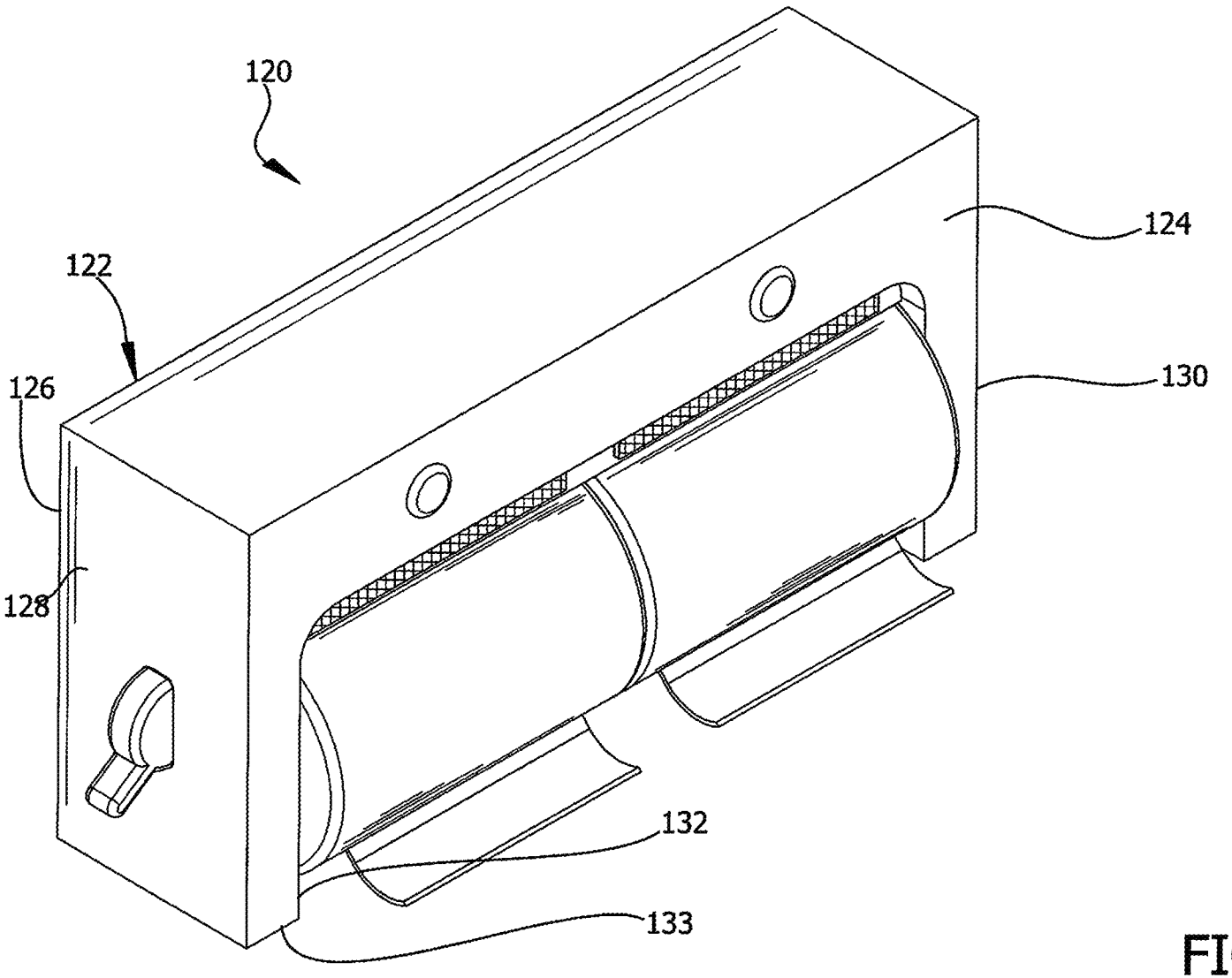
FIG. 8 is a front perspective view of an alternative embodiment of the disclosure.
Figure 9:
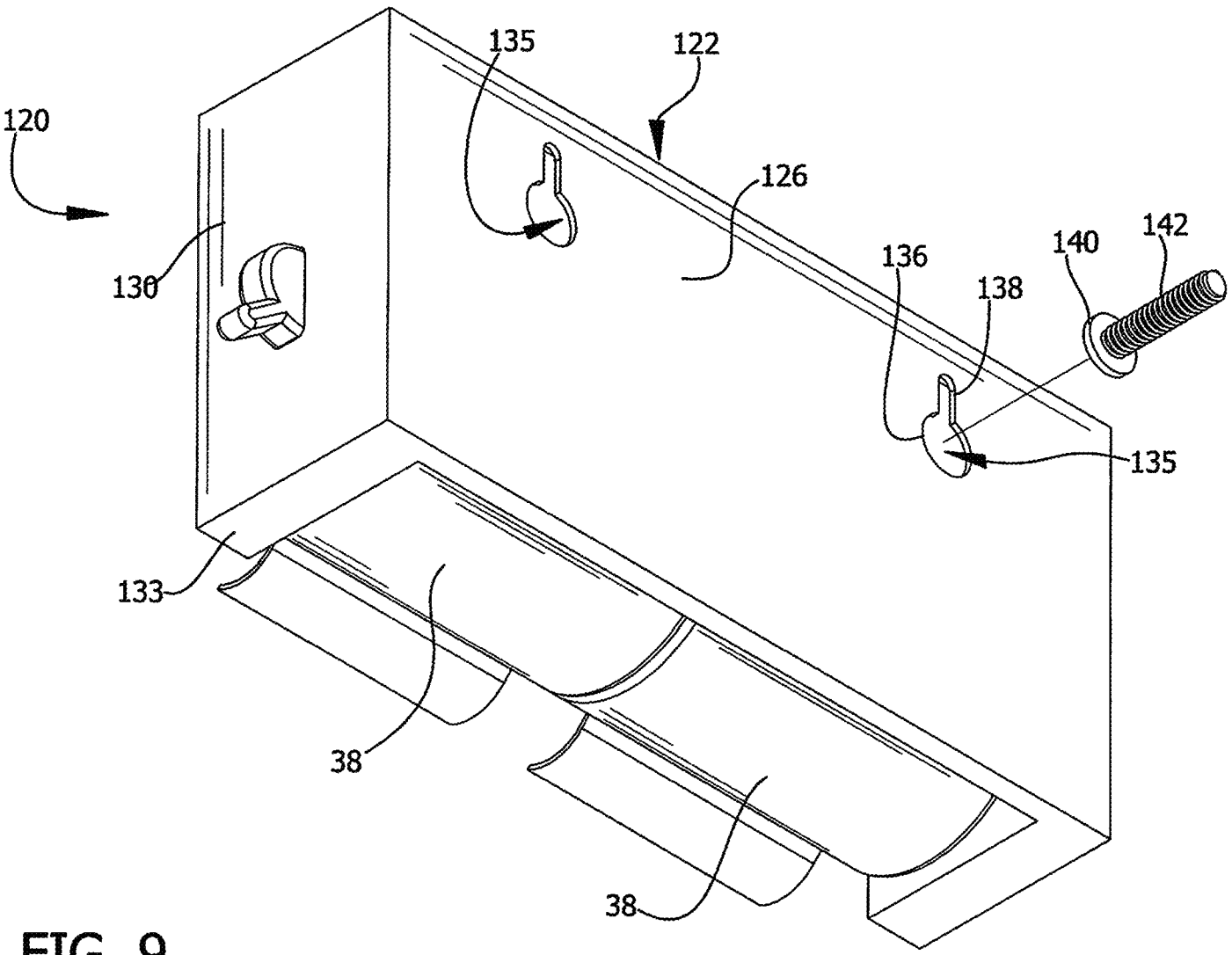
FIG. 9 is a back perspective view of an alternative embodiment of the disclosure.
Figure 10:
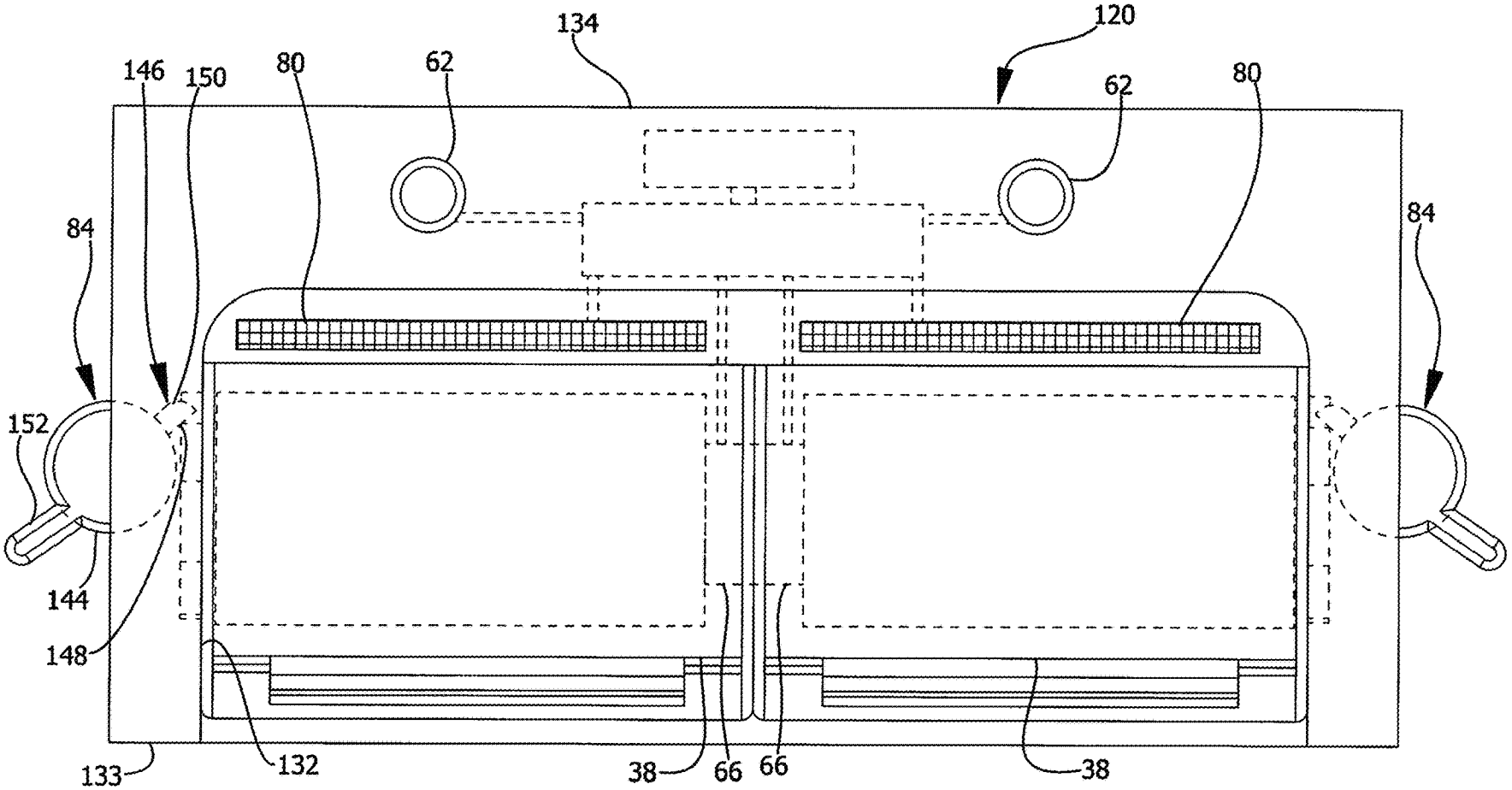
FIG. 10 is a front phantom view of an alternative embodiment of the disclosure.
Figure 11:
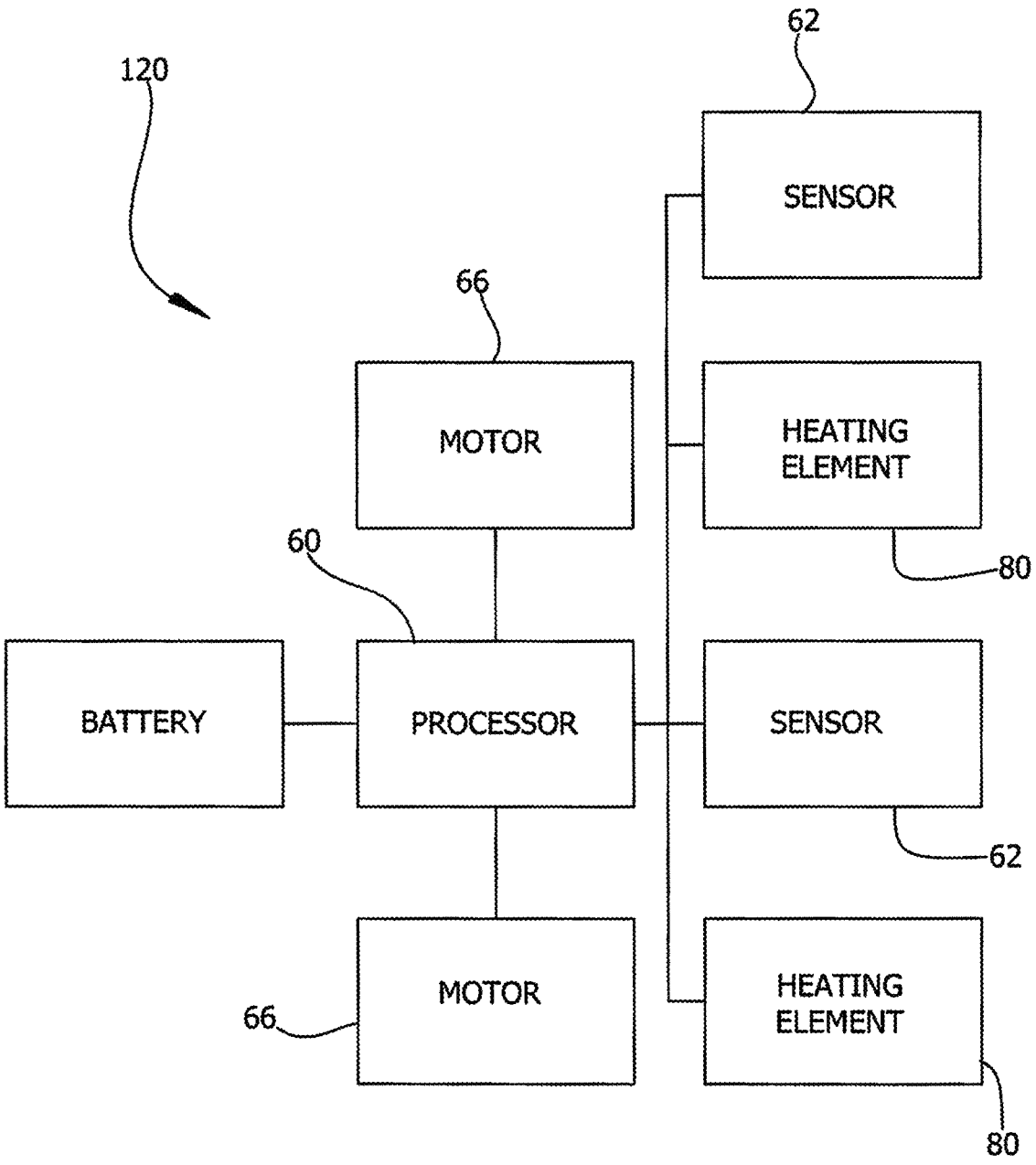
FIG. 11 is a schematic view of an alternative embodiment of the disclosure.

With reference now to the drawings, and in particular to FIGS. 1 through 11 thereof, a new moistened wipes device embodying the principles and concepts of an embodiment of the disclosure and generally designated by the reference numeral 10 will be described.

As best illustrated in FIGS. 1 through 11, the moistened wipes dispensing device 10 generally comprises a stand 12 which includes a base 14 and a stanchion 16 and the base 14 is positionable on a support surface 18, such as a floor in a public restroom for example, such that the stanchion 16 is vertically oriented. The base 14 has a bottom wall 20 and a top wall 22 curving upwardly from the bottom wall 20 such that the base 14 has a dome shape. The top wall 22 has an opening 24 extending into an interior of the base 14 and the opening 24 is aligned with an intersection between the top wall 22 and the bottom wall 20. The stanchion 16 comprises a lower section 26 and a top section 28; the lower section 26 has a bottom end 30 that is coupled to the top wall 22 of the base 14 at a point aligned with an apex 32 of the top wall 22 and the top section 28 has a lower end 34 which is releasably attached to a top end 36 of the lower section 26.

A dispensing unit 38 is attached to the stanchion 16 such that the dispensing unit 38 is elevated above the support surface 18 such that the dispensing unit 38 is positioned at a preferred height to be accessible to a user 40. The dispensing unit 38 contains a roll of moistened wipes 42. Additionally, the dispensing unit 38 has a motion sensing element 44 which actuates the dispensing unit 38 to dispense one of the moistened wipes 42 when the motion sensing element 44 senses motion. In this way the dispensing unit 38 can dispense one of the moistened wipes 42 when the user 40 approaches the dispensing unit 38 thereby facilitating hands-free dispensing of the moistened wipes 42. The dispensing unit 38 includes a warming element 46 which is in thermal communication with an interior of the dispensing unit 38 thereby facilitating the warming element 46 to warm the moistened wipe 42 that is dispensed to enhance comfort for the user 40 by providing a warmed moistened wipe 42.

The dispensing unit 38 comprises a cylinder 48 which has a dispensing slot 50 extending through an outer wall 52 of the cylinder 48. The dispensing slot 50 is elongated to extend substantially between a first lateral wall 54 and a second lateral wall 56 of the cylinder 48 and the cylinder 48 is substantially hollow. An upper end 58 of the top section 28 of the stanchion 16 is coupled to the outer wall 52 at a point that is centrally located between the first lateral wall 54 and the second lateral wall 56. The dispensing unit 38 includes a processor 60 that is positioned within the cylinder 48 and the processor 60 receives an actuate input.

The dispensing unit 38 includes a motion sensor 62 that is attached to the outer wall 52 of the cylinder 48 such that the motion sensor 62 defines the motion sensing element 44 of the dispensing unit 38. In this way the motion sensor 62 can sense motion of the user 40 when the user 40 moves within a trigger distance of the cylinder 48. The motion sensor 62 is electrically coupled to the processor 60 and the processor 60 receives the actuate input when the motion sensor 62 senses motion. The motion sensor 62 may comprise an electronic motion sensor, such as an infra-red motion sensor for example, which has an operational range of less than 2.0 meters.

The dispensing unit 38 includes a spool 64 that is rotatably disposed within the cylinder 48 such that the spool 64 extends between the first lateral wall 54 and the second lateral wall 56 of the cylinder 48. The spool 64 is rotatable in a first direction and the roll of moistened wipes 42 is positioned around the spool 64. The dispensing unit 38 includes a motor 66 that is positioned within the cylinder 48 and the motor 66 is mechanically coupled to a respective end of the spool 64 such that the motor 66 rotates the spool 64 in the first direction when the motor 66 is actuated. The motor 66 is electrically coupled to the processor 60 and the motor 66 is actuated to rotate a predetermined number of rotations when the processor 60 receives the actuate input. In this way a dispensed one of the roll of moistened wipes 42 is urged to extend outwardly through the dispensing slot 50 in the outer wall 52 of the cylinder 48 to be retrieved by the user 40.

The dispensing unit 38 includes a gear 68 which is attached to an opposing end of the spool 64 with respect to the motor 66. The gear 68 has a plurality of teeth 70 each extending away from an outer surface 72 of the gear 68 and the teeth 70 are evenly spaced apart from each other and are distributed around a full circumference of the gear 68. Each of the plurality of teeth 70 has a first side 74 and a second side 76 and the first side 74 of each of the plurality of teeth 70 is perpendicularly oriented with the outer surface 72 of the gear 68. Additionally, the second side 76 of each of the plurality of teeth 70 curves outwardly between the first side 74 and the outer surface 72 of the gear 68.

The dispensing unit 38 includes a heating element 78 that is integrated into the outer wall 52 of the cylinder 48 such that the heating element 78 defines the warming element 46. The heating element 78 is elongated to extend substantially between the first lateral wall 54 and the second lateral wall 56 of the cylinder 48 and the heating element 78 is positioned above the dispensing slot 50 in the outer wall 52 of the cylinder 48. The heating element 78 is electrically coupled to the processor 60 and the heating element 78 is actuated for a predetermined duration of time, ranging between approximately 5.0 seconds and 10.0 seconds, when the processor 60 receives the actuate input such that the heating element 78 heats the dispensed one of the roll of moistened wipes 42. In this way the heating element 78 can enhance comfort for the user 40 when the user 40 employs the dispensed one of the roll of moistened wipes 42. The heating element 78 may comprise an electric heating element of any conventional design which has an operational temperature ranging between approximately 80.0 degrees Fahrenheit and 100.0 degrees Fahrenheit. The dispensing unit 38 includes a power supply 80 which is positioned within the cylinder 48. The power supply 80 is electrically coupled to the processor 60 and the power supply 80 comprises at least one battery 82.

A dispensing mechanism 84 is movably integrated into the stand 12 and the dispensing mechanism 84 can be manipulated by the user 40 in the event that the dispensing unit 38 is not operational and will not dispense one of the roll of moistened wipes 42. The dispensing mechanism 84 is in mechanical communication with the dispensing unit 38 such that the dispensing mechanism 84 manually actuates the dispensing unit 38 to dispense one of the roll of moistened wipes 42. The dispensing mechanism 84 comprises a pedal 86 that has a front end 88 and a back end 90. The pedal 86 is positioned in the base 14 such that the pedal 86 extends outwardly through the opening 24 in the top wall 22 of the base 14 having the front end 88 being positioned outside of the base 14 such that the pedal 86 can be stepped upon by the user 40. The pedal 86 is biased into a home position and the pedal 86 is urgeable into an actuating position and the pedal 86 is urged into the actuating position when the user 40 steps on the pedal 86.

The dispensing mechanism 84 includes a biasing member 92 that is coupled between a bottom surface of the pedal 86 and the bottom wall 20 of the base 14. The biasing member 92 biases the pedal 86 into the home position having the pedal 86 lying on a horizontal plane. Furthermore, the pedal 86 is oriented to lie on an angled plane when the pedal 86 is urged into the actuating position. The dispensing mechanism 84 includes a first linkage arm 94 which has a first end 96 that is pivotally coupled to the back end 90 of the pedal 86 and the first linkage arm 94 angles downwardly from the pedal 86 toward the bottom wall 20 of the base 14.

The dispensing mechanism 84 includes a second linkage arm 98 that has a primary end 100 which is pivotally coupled to a second end 102 of the first linkage arm 94. The second linkage arm 98 is vertically oriented such that the second linkage arm 98 extends upwardly through the stanchion 16 and into the cylinder 48 such that a secondary end 104 of the second linkage arm 98 is positioned within the cylinder 48. The second linkage arm 98 has a series of bends 106 each being positioned closer to a secondary end 104 than the primary end 100. The series of bends 106 defines a middle portion 108 of the second linkage arm 98 that is perpendicularly oriented with and extends laterally from a lower portion 110 of the second linkage arm 98 and an upper portion 112 of the second linkage arm 98 which is perpendicularly oriented with and extends upwardly from the middle portion 108. The lower portion 110 is associated with the primary end 100 of the second linkage arm 98 and the upper portion 112 is associated with the secondary end 104 of the second linkage arm 98.

The second linkage arm 98 has a foot 114 extending laterally away from the secondary end 104 of the second linkage arm 98. The foot 114 has an upper surface 116 that is perpendicularly oriented with the upper portion 112 and the foot 114 has a lower surface 118 curving downwardly between the upper surface 116 and the upper portion 112. The upper surface 116 abuts the first side 74 of a respective one of the plurality of teeth 70 on the gear 68 of the dispensing unit 38. The second linkage arm 98 is urged upwardly when the pedal 86 is urged into the actuating position thereby rotating the gear 68. In this way the spool 64 is rotated to urge the dispensed one of the roll of moistened wipes 42 outwardly through the dispensing slot 50 in the outer wall 52 of the cylinder 48 in the event that the dispensing unit 38 is not functional. The second side 76 of each of the plurality of teeth 70 on the gear 68 slides along the lower surface 118 of the foot 114 when the motor 66 rotates the spool 64 such that the foot 114 does not inhibit the gear 68 from rotating when the motor 66 rotates the spool 64.

In an alternative embodiment 120 shown in FIGS. 8-11, a housing 122 is included that has a front wall 124 and a back wall 126 and a first lateral wall 128 and a second lateral wall 130. The front wall 124 has a recess 132 which extends from a bottom wall 133 of the housing 122 toward a top wall 134 of the housing 122 and the recess 132 extends substantially between the first lateral wall 128 and the second lateral wall 130 of the housing 122. The housing 122 has a pair of fastener openings 135 each extending through the back wall 126. Furthermore, each of the pair of fastener openings 135 includes a circular portion 136 and a lobe portion 138 extending upwardly from the circular portion 136. The circular portion 136 insertably receives a head 140 of a fastener 142 thereby facilitating the housing 122 to be lowered onto the fastener 142 such that the head 140 is positioned in the lobe portion 138. In this way the head 140 of the fastener 142 is inhibited from passing through the lobe portion 138 for mounting the housing 122 to a vertical support surface.

Continuing in the alternative embodiment 120 a pair of the dispensing units 38 is provided and each of the pair of dispensing units 38 is positioned in the recess 132 such that the pair of dispensing units 38 is laterally distributed along the recess 132. The alternative embodiment 120 includes a pair of the dispensing mechanisms 84 that is each movably integrated into a respective one of the first lateral wall 54 and the second lateral wall 56 of the housing 122. Each of the pair of dispensing mechanisms 84 comprises a wheel 144 that is rotatably integrated into the housing 122. The wheel 144 associated with each of the pair of dispensing mechanisms 84 extends partially into an interior of the housing 122.

Each of the pair of dispensing mechanisms 84 includes a finger 146 which extends laterally away from the wheel 144 such that the finger 146 is positioned inside of the housing 122. The finger 146 has a bottom side 148 that is perpendicularly oriented with the wheel 144 and a top side 150 curving upwardly between the bottom side 148 and the wheel 144. The bottom side 148 abuts the first side 74 of a respective one of the plurality of teeth 70 on the gear 68 of a respective one of the dispensing units 38. Each of the pair of dispensing units 38 includes a lever 152 extending laterally away from the wheel 144 in an opposite direction from the finger 146 such that the lever 152 is positioned outside of the housing 122 wherein the lever 152 is configured to be manipulated by the user 40. The finger 146 on the wheel 144 of a respective one of the pair of dispensing mechanisms 84 rotates the gear 68 of the respective dispensing unit 38 when the lever 152 on the wheel 144 of the respective pair of dispensing units 38 is lifted upwardly by the user 40. In this way the dispensed one of the roll of moistened wipes 42 is urged outwardly from the dispensing slot 50 in the respective dispensing unit 38.

In use, the dispensing unit 38 is actuated to dispense one of the roll of moistened wipes 42 when the motion sensor 62 senses motion of the user 40 when the user 40 moves their hand in front of the motion sensor 62 and the heating element 78 is actuated to heat the dispensed one of the roll of moistened wipes 42. In this way the user 40 can employ the warmed moistened wipe 42 to clean a toilet seat, for example, in a public restroom prior to using the toilet or to clean their hands after using the restroom. Furthermore, the user 40 can step upon the pedal 86 to dispense one of the roll of moistened wipes 42 in the event that the dispensing unit 38 is not functioning properly. In this way the user 40 can retrieve one of the roll of moistened wipes 42 in a hands-free manner thereby reducing the transmission of germs that commonly occurs from touching an object that has been touched by multiple different people.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A moistened wipes dispensing device for automatically dispensing a moistened wipe that facilitates a user to wash themselves, said device comprising:

a stand including a base and a stanchion, said base being positionable on a support surface such that said stanchion is vertically oriented;

a dispensing unit being attached to said stanchion such that said dispensing unit is elevated above the support surface wherein said dispensing unit is configured to be positioned at a preferred height to be accessible to a user, said dispensing unit containing a roll of moistened wipes, said dispensing unit having a motion sensing element which actuates said dispensing unit to dispense one of said moistened wipes when said motion sensing element senses motion wherein said dispensing unit is configured to dispense one of said moistened wipes when the user approaches said dispensing unit thereby facilitating hands-free dispensing of said moistened wipes, said dispensing unit including a warming element being in thermal communication with an interior of said dispensing unit thereby facilitating said warming element to warm said moistened wipe that is dispensed wherein said warming element is configured to enhance comfort for the user by providing a warmed moistened wipe; and a dispensing mechanism being movably integrated into said stand wherein said dispensing mechanism is configured to be manipulated by the user in the event that said dispensing unit is not operational and will not dispense one of said roll of moistened wipes, said dispensing mechanism being in mechanical communication with said dispensing unit such that said dispensing mechanism manually actuates said dispensing unit to dispense one of said roll of moistened wipes.

2. The assembly according to claim 1, wherein:

said base has a bottom wall and a top wall curving upwardly from said bottom wall such that said base has a dome shape;

said top wall has an opening extending into an interior of said base;

said opening is aligned with an intersection between said top wall and said bottom wall;

said stanchion comprise a lower section and a top section;

said lower section having a bottom end being coupled to said top wall of said base at a point aligned with an apex of said top wall; and said top section has a lower end which is releasably attached to a top end of said lower section.

3. The assembly according to claim 2, wherein said dispensing unit comprises:

a cylinder having a dispensing slot extending through an outer wall of said cylinder, said dispensing slot being elongated to extend substantially between a first lateral wall and a second lateral wall of said cylinder, said cylinder being substantially hollow, an upper end of said top section of said stanchion being coupled to said outer wall at a point being centrally located between said first lateral wall and said second lateral wall;

a processor being positioned within said cylinder, said processor receiving an actuate input; and a motion sensor being attached to said outer wall of said cylinder such that said motion sensor defines said motion sensing element of said dispensing unit wherein said motion sensor is configured to sense motion of the user when the user moves within a trigger distance of said cylinder, said motion sensor being electrically coupled to said processor, said processor receiving said actuate input when said motion sensor senses motion.

4. The assembly according to claim 3, wherein said dispensing unit includes:

a spool being rotatably disposed within said cylinder such that said spool extends between said first lateral wall and said second lateral wall of said cylinder, said spool being rotatable in a first direction, said roll of moistened wipes being positioned around said spool; and a motor being positioned within said cylinder, said motor being mechanically coupled to a respective end of said spool such that said motor rotates said spool in said first direction when said motor is actuated, said motor being electrically coupled to said processor, said motor being actuated to rotate a predetermined number of rotations when said processor receives said actuate input such that a dispensed one of said roll of moistened wipes is urged to extend outwardly through said dispensing slot in said outer wall of said cylinder wherein said dispensed one of said roll of moistened wipes is configured to be retrieved by the user.

5. The assembly according to claim 4, wherein:

said dispensing unit includes a gear being attached to an opposing end of said spool with respect to said motor;

said gear has a plurality of teeth each extending away from an outer surface of said gear;

said plurality of teeth are evenly spaced apart from each other and are distributed around a full circumference of said gear;

each of said plurality of teeth has a first side and a second side;

said first side of each of said plurality of teeth is perpendicularly oriented with said outer surface of said gear; and said second side of each of said plurality of teeth curves outwardly between said first side and said outer surface of said gear.

6. The assembly according to claim 3, wherein:

said dispensing unit includes a heating element being integrated into said outer wall of said cylinder such that said heating element defines said warming element;

said heating element is elongated to extend substantially between said first lateral wall and said second lateral wall of said cylinder;

said heating element is positioned above said dispensing slot in said outer wall of said cylinder;

said heating element is electrically coupled to said processor;

said heating element is actuated for a predetermined duration of time when said processor receives said actuate input such that said heating element heats said dispensed one of said roll of moistened wipes wherein said heating element is configured to enhance comfort for the user when the user employs said dispensed one of said roll of moistened wipes; and said dispensing unit includes a power supply being positioned within said cylinder, said power supply being electrically coupled to said processor, said power supply comprising at least one battery.

7. The assembly according to claim 2, wherein:

said dispensing mechanism comprises a pedal having a front end and a back end;

said pedal is positioned in said base such that said pedal extends outwardly through said opening in said top wall of said base having said front end being positioned outside of said base wherein said pedal is configured to be stepped upon by the user;

said pedal is biased into a home position;

said pedal is urgeable into an actuating position;

said dispensing mechanism includes a biasing member being coupled between a bottom surface of said pedal and said bottom wall of said base;

said biasing member biasing said pedal into said home position having said pedal lying on a horizontal plane; and said pedal being oriented to lie on an angled plane when said pedal is urged into said actuating position.

8. The assembly according to claim 7, wherein:

said dispensing mechanism includes a first linkage arm having a first end being pivotally coupled to said back end of said pedal;

said first linkage arm angles downwardly from said pedal toward said bottom wall of said base;

said dispensing mechanism includes a second linkage arm having a primary end being pivotally coupled to a second end of said first linkage arm; and said second linkage arm is vertically oriented such that said second linkage arm extends upwardly through said stanchion and into said cylinder such that a secondary end of said second linkage arm is positioned within said cylinder.

9. The assembly according to claim 8, wherein:

said second linkage arm has a series of bends each being positioned closer to a secondary end than said primary end to define a middle portion of said second linkage arm being perpendicularly oriented with and extending laterally away from a lower portion of said second linkage arm and an upper portion of said second linkage arm being perpendicularly oriented with and extending upwardly from said middle portion;

said lower portion is associated with said primary end of said second linkage arm;

said upper portion is associated with said secondary end of said second linkage arm;

said second linkage arm has a foot extending laterally away from said secondary end of said second linkage arm;

said foot has an upper surface being perpendicularly oriented with said upper portion; and said foot having a lower surface curving downwardly between said upper surface and said upper portion.

10. The assembly according to claim 9, wherein said dispensing unit includes a gear having a plurality of teeth each extending away from an outer surface of said gear;

each of said plurality of teeth has a first side and a second side;

said first side of each of said plurality of teeth is perpendicularly oriented with said outer surface of said gear;

said second side of each of said plurality of teeth curves outwardly between said first side and said outer surface of said gear;

said upper surface of said foot on said second linkage arm abuts said first side of a respective one of said plurality of teeth on said gear of said dispensing unit;

said second linkage arm is urged upwardly when said pedal is urged into said actuating position thereby rotating said gear such that said spool is rotated to urge said dispensed one of said roll of moistened wipes outwardly through said dispensing slot in said outer wall of said cylinder in the event that said dispensing unit is not functional; and said second side of each of said plurality of teeth on said gear slides along said lower surface of said foot when said dispensing unit rotates said spool such that said foot does not inhibit said gear from rotating when said dispensing unit rotates said spool.

11. A moistened wipes dispensing device for automatically dispensing a moistened wipe that facilitates a user to wash themselves, said device comprising:

a stand including a base and a stanchion, said base being positionable on a support surface such that said stanchion is vertically oriented, said base having a bottom wall and a top wall curving upwardly from said bottom wall such that said base has a dome shape, said top wall having an opening extending into an interior of said base, said opening being aligned with an intersection between said top wall and said bottom wall, said stanchion comprising a lower section and a top section, said lower section having a bottom end being coupled to said top wall of said base at a point aligned with an apex of said top wall, said top section having a lower end which is releasably attached to a top end of said lower section;

a dispensing unit being attached to said stanchion such that said dispensing unit is elevated above the support surface wherein said dispensing unit is configured to be positioned at a preferred height to be accessible to a user, said dispensing unit containing a roll of moistened wipes, said dispensing unit having a motion sensing element which actuates said dispensing unit to dispense one of said moistened wipes when said motion sensing element senses motion wherein said dispensing unit is configured to dispense one of said moistened wipes when the user approaches said dispensing unit thereby facilitating hands-free dispensing of said moistened wipes, said dispensing unit including a warming element being in thermal communication with an interior of said dispensing unit thereby facilitating said warming element to warm said moistened wipe that is dispensed wherein said warming element is configured to enhance comfort for the user by providing a warmed moistened wipe, said dispensing unit comprising:

a cylinder having a dispensing slot extending through an outer wall of said cylinder, said dispensing slot being elongated to extend substantially between a first lateral wall and a second lateral wall of said cylinder, said cylinder being substantially hollow, an upper end of said top section of said stanchion being coupled to said outer wall at a point being centrally located between said first lateral wall and said second lateral wall;

a processor being positioned within said cylinder, said processor receiving an actuate input;

a motion sensor being attached to said outer wall of said cylinder such that said motion sensor defines said motion sensing element of said dispensing unit wherein said motion sensor is configured to sense motion of the user when the user moves within a trigger distance of said cylinder, said motion sensor being electrically coupled to said processor, said processor receiving said actuate input when said motion sensor senses motion;

a spool being rotatably disposed within said cylinder such that said spool extends between said first lateral wall and said second lateral wall of said cylinder, said spool being rotatable in a first direction, said roll of moistened wipes being positioned around said spool;

a motor being positioned within said cylinder, said motor being mechanically coupled to a respective end of said spool such that said motor rotates said spool in said first direction when said motor is actuated, said motor being electrically coupled to said processor, said motor being actuated to rotate a predetermined number of rotations when said processor receives said actuate input such that a dispensed one of said roll of moistened wipes is urged to extend outwardly through said dispensing slot in said outer wall of said cylinder wherein said dispensed one of said roll of moistened wipes is configured to be retrieved by the user;

a gear being attached to an opposing end of said spool with respect to said motor, said gear having a plurality of teeth each extending away from an outer surface of said gear, said plurality of teeth being evenly spaced apart from each other and being distributed around a full circumference of said gear, each of said plurality of teeth having a first side and a second side, said first side of each of said plurality of teeth being perpendicularly oriented with said outer surface of said gear, said second side of each of said plurality of teeth curving outwardly between said first side and said outer surface of said gear;

a heating element being integrated into said outer wall of said cylinder such that said heating element defines said warming element, said heating element being elongated to extend substantially between said first lateral wall and said second lateral wall of said cylinder, said heating element being positioned above said dispensing slot in said outer wall of said cylinder, said heating element being electrically coupled to said processor, said heating element being actuated for a predetermined duration of time when said processor receives said actuate input such that said heating element heats said dispensed one of said roll of moistened wipes wherein said heating element is configured to enhance comfort for the user when the user employs said dispensed one of said roll of moistened wipes; and a power supply being positioned within said cylinder, said power supply being electrically coupled to said processor, said power supply comprising at least one battery; and a dispensing mechanism being movably integrated into said stand wherein said dispensing mechanism is configured to be manipulated by the user in the event that said dispensing unit is not operational and will not dispense one of said roll of moistened wipes, said dispensing mechanism being in mechanical communication with said dispensing unit such that said dispensing mechanism manually actuates said dispensing unit to dispense one of said roll of moistened wipes, said dispensing mechanism comprising:

a pedal having a front end and a back end, said pedal being positioned in said base such that said pedal extends outwardly through said opening in said top wall of said base having said front end being positioned outside of said base wherein said pedal is configured to be stepped upon by the user, said pedal being biased into a home position, said pedal being urgeable into an actuating position, said pedal being urged into said actuating position when the user steps on said pedal;

a biasing member being coupled between a bottom surface of said pedal and said bottom wall of said base, said biasing member biasing said pedal into said home position having said pedal lying on a horizontal plane, said pedal being oriented to lie on an angled plane when said pedal is urged into said actuating position;

a first linkage arm having a first end being pivotally coupled to said back end of said pedal, said first linkage arm angling downwardly from said pedal toward said bottom wall of said base; and a second linkage arm having a primary end being pivotally coupled to a second end of said first linkage arm, said second linkage arm being vertically oriented such that said second linkage arm extends upwardly through said stanchion and into said cylinder such that a secondary end of said second linkage arm is positioned within said cylinder, said second linkage arm having a series of bends each being positioned closer to a secondary end than said primary end to define a middle portion of said second linkage arm being perpendicularly oriented with and extending laterally from a lower portion of said second linkage arm and an upper portion of said second linkage arm being perpendicularly oriented with and extending upwardly from said middle portion, said lower portion being associated with said primary end of said second linkage arm, said upper portion being associated with said secondary end of said second linkage arm, said second linkage arm having a foot extending laterally away from said secondary end of said second linkage arm, said foot having an upper surface being perpendicularly oriented with said upper portion, said foot having a lower surface curving downwardly between said upper surface and said upper portion, said upper surface abutting said first side of a respective one of said plurality of teeth on said gear of said dispensing unit, said second linkage arm being urged upwardly when said pedal is urged into said actuating position thereby rotating said gear such that said spool is rotated to urge said dispensed one of said roll of moistened wipes outwardly through said dispensing slot in said outer wall of said cylinder in the event that said dispensing unit is not functional, said second side of each of said plurality of teeth on said gear sliding along said lower surface of said foot when said motor rotates said spool such that said foot does not inhibit said gear from rotating when said motor rotates said spool.

12. The assembly according to claim 11, wherein:

said device includes a housing having a front wall and a back wall and a first lateral wall and a second lateral wall;

said front wall having a recess extending from a bottom wall of said housing toward a top wall of said housing;

said recess extends substantially between said first lateral wall and said second lateral wall;

said housing has a pair of fastener openings each extending through said back wall;

each of said pair of fastener openings includes a circular portion and a lobe portion extending upwardly from said circular portion wherein said circular portion is configured to insertably receive a head of a fastener thereby facilitating said housing to be lowered onto said fastener such that said head is positioned in said lobe portion thereby inhibiting said head from passing through said lobe portion for mounting said housing to a vertical support surface;

a pair of said dispensing units is provided; and each of said pair of dispensing units is positioned in said recess such that said pair of dispensing units is laterally distributed along said recess.

13. The assembly according to claim 12, wherein:

a pair of said dispensing mechanisms is provided;

each of said pair of dispensing mechanisms is movably integrated into a respective one of said first lateral wall and said second lateral wall of said housing;

each of said pair of dispensing mechanisms comprises a wheel being rotatably integrated into said housing;

said wheel associated with each of said pair of dispensing mechanisms extends partially into an interior of said housing;

each of said pair of dispensing mechanisms includes a finger extending laterally away from said wheel such that said finger is positioned inside of said housing, said finger having a bottom side being perpendicularly oriented with said wheel and a top side curving upwardly between said bottom side and said wheel, said bottom side abutting said first side of a respective one of said plurality of teeth on said gear of a respective one of said dispensing units;

each of said pair of dispensing units includes a lever extending laterally away from said wheel in an opposite direction from said finger such that said lever is positioned outside of said housing wherein said lever is configured to be manipulated by the user; and said finger on said wheel of a respective one of said pair of dispensing mechanisms rotating said gear of said respective dispensing unit when said lever on said wheel of said respective pair of dispensing units is lifted upwardly by the user thereby facilitating said dispensed one of said roll of moistened wipes to be urged outwardly from said dispensing slot in said respective dispensing unit.

* * * * *